US009159337B2

(12) United States Patent
Villemoes et al.

(10) Patent No.: US 9,159,337 B2
(45) Date of Patent: Oct. 13, 2015

(54) APPARATUS AND METHOD FOR GENERATING A HIGH FREQUENCY AUDIO SIGNAL USING ADAPTIVE OVERSAMPLING

(75) Inventors: Lars Villemoes, Jaerfaella (SE); Per Ekstrand, Stockholm (SE); Sascha Disch, Fuerth (DE); Frederik Nagel, Nuremberg (DE); Stephan Wilde, Wendelstein (DE)

(73) Assignees: Dolby International AB, Amsterdam Zuid-Oost (NL); Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 766 days.

(21) Appl. No.: 13/503,248

(22) PCT Filed: May 25, 2010

(86) PCT No.: PCT/EP2010/057130

§ 371 (c)(1),
(2), (4) Date: Jul. 12, 2012

(87) PCT Pub. No.: WO2011/047886

PCT Pub. Date: Apr. 28, 2011

(65) Prior Publication Data

US 2012/0281859 A1 Nov. 8, 2012

Related U.S. Application Data

(60) Provisional application No. 61/253,776, filed on Oct. 21, 2009.

(51) Int. Cl.

| | |
|---|---|
| ***H04R 3/04*** | (2006.01) |
| ***G10L 21/038*** | (2013.01) |
| *G10L 19/025* | (2013.01) |

(52) U.S. Cl.

CPC ..... *G10L 21/038* (2013.01); *G10L 19/025* (2013.01)

(58) Field of Classification Search

CPC ..... H04R 3/04; G10L 21/038
USPC ..... 381/98
See application file for complete search history.

(56) References Cited

U.S. PATENT DOCUMENTS

| | | | |
|---|---|---|---|
| 7,835,915 | B2 | 11/2010 | Kim et al. |
| 8,843,378 | B2 | 9/2014 | Herre et al. |

(Continued)

FOREIGN PATENT DOCUMENTS

| | | |
|---|---|---|
| CN | 1510662 | 7/2004 |
| JP | 2012-501273 | 1/2012 |

(Continued)

OTHER PUBLICATIONS

Dietz, M., S. Liljeryd, K. Kjoerling and O. Kunz "Spectral Band Replication, a Novel Approach in Audio Coding", in 112th AES convention, Munich, May 2002.

(Continued)

*Primary Examiner* — Sonia Gay
(74) *Attorney, Agent, or Firm* — Michael A. Glenn; Perkins Coie LLP

(57) ABSTRACT

An apparatus for generating a high frequency audio signal that includes an analyzer for analyzing an input signal to determine a transient information adaptively. Additionally a spectral converter is provided for converting the input signal into an input spectral representation. A spectral processor processes the input spectral representation to generate a processed spectral representation including values for higher frequencies than the input spectral representation. A time converter is configured for converting the processed spectral representation to a time representation, wherein the spectral converter or the time converter are controllable to perform a frequency domain oversampling for the first portion of the input signal having the transient information associated and to not perform the frequency domain oversampling for the second portion of the input signal not having the associated transient information.

15 Claims, 7 Drawing Sheets

(56) References Cited

U.S. PATENT DOCUMENTS

| | | | | |
|---|---|---|---|---|
| 2004/0078194 | A1 | 4/2004 | Liljeryd et al. | |
| 2004/0125878 | A1 | 7/2004 | Liljeryd et al. | |
| 2009/0252356 | A1 * | 10/2009 | Goodwin et al. | 381/310 |
| 2009/0259906 | A1 | 10/2009 | Garudadri et al. | |

FOREIGN PATENT DOCUMENTS

| | | | |
|---|---|---|---|
| RU | 2345506 | C2 | 1/2009 |
| WO | 9013887 | | 11/1990 |
| WO | WO 2009/095169 | | 8/2009 |
| WO | 2009115211 | | 9/2009 |
| WO | WO-2010/108895 | | 9/2010 |

OTHER PUBLICATIONS

Laroche L., Dolson M.: "Improved phase vocoder timescale modification of audio", IEEE Trans. Speech and Audio Processing, vo. 7, No. 3, pp. 323-332.

Nagel, F., Sascha Disch, "A harmonic bandwidth extension method for audio codecs", ICASSP International Conference on Acoustics, Speech and Signal Processing, IEEE CNF, Taipei, Taiwan, Apr. 2009.

Puckette, M., Phase-locked Vocoder. IEEE ASSP Conference on Applications of Signal Processing to Audio and Acoustics, Mohonk 1995.

Nagel, et al., "A Phase Vocoder Driven Bandwidth Extension Method with Novel Transient Handling for Audio Codecs", 126$^{th}$ AES Convention, Preprints, Munich, Germany, May 2009.

* cited by examiner

APPARATUS AND METHOD FOR GENERATING A HIGH FREQUENCY AUDIO SIGNAL USING ADAPTIVE OVERSAMPLING

CROSS-REFERENCE TO RELATED APPLICATIONS

This application is a National Phase entry claiming priority to International Application No. PCT/EP2010/057130, filed May 25, 2010, which is incorporated herein by reference in its entirety, and additionally claims priority from U.S. Application No. 61/253,776, filed Oct. 21, 2009, which is also incorporated herein by reference in its entirety.

BACKGROUND OF THE INVENTION

The present invention relates to coding of audio signals, and in particular to high frequency reconstruction methods including a frequency domain transposer such as a harmonic transposer.

Conventionally, there are several methods for high frequency reconstruction using harmonic transposition, or time-stretching or similar. One method used is based on phase vocoders. These operate under the principle of doing a frequency analysis with sufficiently high frequency resolution, and the signal modification in the frequency domain prior to synthesizing the signal. The time-stretch or transposition depends on the combination of analysis window, analysis window stride, synthesis window, synthesis window stride, as well as phase adjustments of the analyzed signal.

One of the problem that inevitably exists with these methods is the contradiction between the needed frequency resolution in order to get a high quality transposition for stationary sounds, and the transient response of the system for transient sounds.

An algorithm which employs phase vocoders as, for example, described in M. Puckette. Phase-locked Vocoder. IEEE ASSP Conference on Applications of Signal Processing to Audio and Acoustics, Mohonk 1995.", Röbel, A.: Transient detection and preservation in the phase vocoder; citeseer.ist.psu.edu/679246.html; Laroche L., Dolson M.: "Improved phase vocoder timescale modification of audio", IEEE Trans. Speech and Audio Processing, vol. 7, no. 3, pp. 323-332 and U.S. Pat. No. 6,549,884 Laroche, J. & Dolson, M.: Phase-vocoder pitch-shifting for the patch generation, has been presented in Frederik Nagel, Sascha Disch, "A harmonic bandwidth extension method for audio codecs," ICASSP International Conference on Acoustics, Speech and Signal Processing, IEEE CNF, Taipei, Taiwan, April 2009. However, this method called "harmonic bandwidth extension" (HBE) is prone to quality degradations of transients contained in the audio signal, as described in Frederik Nagel, Sascha Disch, Nikolaus Rettelbach, "A phase vocoder driven bandwidth extension method with novel transient handling for audio codecs," 126th AES Convention, Munich, Germany, May 2009, since vertical coherence over subbands is not guaranteed to be preserved in the standard phase vocoder algorithm and, moreover, the re-calculation of the Discrete Fourier Transform (DFT) phases has to be performed on isolated time blocks of a transform implicitly assuming circular periodicity.

It is known that specifically two kinds of artifacts due to the block based phase vocoder processing can be observed. These, in particular, are dispersion of the waveform and temporal aliasing due to temporal cyclic convolution effects of the signal due to the application of newly calculated phases.

In other words, because of the application of a phase modification on the spectral values of the audio signal in the BWE algorithm, a transient contained in a block of the audio signal may be wrapped around the block, i.e., cyclically convolved back into the block. This results in temporal aliasing and, consequently, leads to a degradation of the audio signal.

Therefore, methods for a special treatment for signal parts containing transients should be employed. However, especially since the BWE algorithm is performed on the decoder side of a codec chain, computational complexity is a serious issue. Accordingly, measures against the just-mentioned audio signal degradation should not come at the price of a largely increased computational complexity.

SUMMARY

According to an embodiment, an apparatus for generating a high frequency audio signal may have: an analyzer for analyzing an input signal to determine a transient information, wherein a first portion of the input signal has associated the transient information, and the second later portion of the input signal does not have the transient information; a spectral converter for converting the input signal into an input spectral representation; a spectral processor for processing the input spectral representation to generate a processed spectral representation including values for higher frequencies than the input spectral representation; and a time converter for converting the processed spectral representation to a time representation, wherein the spectral converter or the time converter are controllable to perform a frequency domain oversampling for the first portion of the input signal having associated the transient information and to not perform the frequency domain oversampling for the second portion of the input signal or to perform a frequency domain oversampling with a smaller oversampling factor compared to the first portion of the input signal.

According to another embodiment, a method of generating a high frequency audio signal may have the steps of: analyzing an input signal to determine a transient information, wherein a first portion of the input signal has associated the transient information, and the second later portion of the input signal does not have the transient information; converting the input signal into an input spectral representation; processing the input spectral representation to generate a processed spectral representation including values for higher frequencies than the input spectral representation; and converting the processed spectral representation to a time representation, wherein in the step of converting into an input spectral representation or in the step of converting to a time representation a controllable frequency domain oversampling is performed for the first portion of the input signal having the transient information, wherein the frequency domain oversampling for the second portion of the input signal is not performed or wherein a frequency domain oversampling with a smaller oversampling factor compared to the first portion of the input signal is performed for the second portion of the input signal.

Another embodiment may have a computer program for performing, when running on a computer, the inventive method for generating a high-frequency audio signal.

The present invention uses the feature that transients are treated separately, i.e., different from non-transient portions of the audio signal. To this end, an apparatus for generating a high frequency audio signal comprises an analyzer for analyzing the input signal to determine a transient information, where for a first portion of the input signal, the transient information is associated and a second later time portion of the input signal does not have the transient information. The analyzer can actually analyze the audio signal itself, i.e., by analyzing its energy distribution or change in energy to determine a transient portion. This necessitates a certain look-ahead so that, for example, a core coder output signal is analyzed at a certain time in advance so that the result of the analysis can be used for generating the high frequency audio signal based on the core coder output signal. A different alternative is to perform a transient detection on the encoder side and to associate a certain side information such as a certain bit in a bitstream to a time portion of the signal which has the transient characteristic. Then, the analyzer is configured for extracting this transient information bit from the bitstream in order to determine whether a certain portion of this input audio signal is transient or not. Additionally, the apparatus for generating a high frequency audio signal comprises a spectral converter for converting the input signal into the input spectral representation. The high frequency reconstruction is performed within the filterbank domain, i.e., subsequent to the spectral conversion using the spectral converter. To this end, a spectral processor processes the input spectral representation to generate a processed spectral representation comprising values for higher frequency than the input spectral representation. A conversion back into the time domain is done by a subsequently connected time converter for converting the processed spectral representation to a time representation. In accordance with the present invention, the spectral converter and/or the time converter are controllable to perform a frequency domain oversampling for the first portion of the input signal having associated the transient information and to not perform the frequency domain oversampling for the second portion of the input signal not having associated transient information.

The present invention is advantageous in that it results in a reduction of complexity while nevertheless retaining good transient performance for transpositions such as harmonic transpositions in combined filterbanks. The present invention therefore, comprises an apparatus and method having adaptive oversampling in frequency of combined transposers in a filterbank, where the oversampling is controlled by a transient detector in accordance with an embodiment.

In an embodiment, the spectral processor performs an harmonic transposition from a base band into a first high band portion, and additional high band portions such as three or four high band portions. In one embodiment, each high band portion has a separate synthesis filterbank such as an inverse FFT. In another embodiment, which is computationally more efficient, a single synthesis filterbank such as a single 1024 inverse FFT is used. For both cases, the frequency domain oversampling is obtained by increasing the transform size by an oversampling factor such as a factor of 1.5. The additional FFT input is obtained by zero padding, i.e., by adding a certain number of zeros before the first value of a windowed frame and by adding another number of zeros at the end of a windowed frame. In response to an FFT control signal, the size of the FFT is increased by the oversampling and zero padding is performed, although other values such as certain noise values different from zero can also be padded to windowed frames.

The spectral processor can additionally be controlled by the analyzer output signal, i.e., by the transient information so that for the case of a transient portion where the FFT is longer compared to the non-transient or non-padded case, start index values for the mapping of lines in a filterbank, i.e., for different transposition "rounds" or transposition iterations are changed depending on the oversampling factor, where this change comprises a multiplication of the used transform domain index by the oversampling factor to obtain the new start index for a patching operation for the frequency domain oversampled case.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
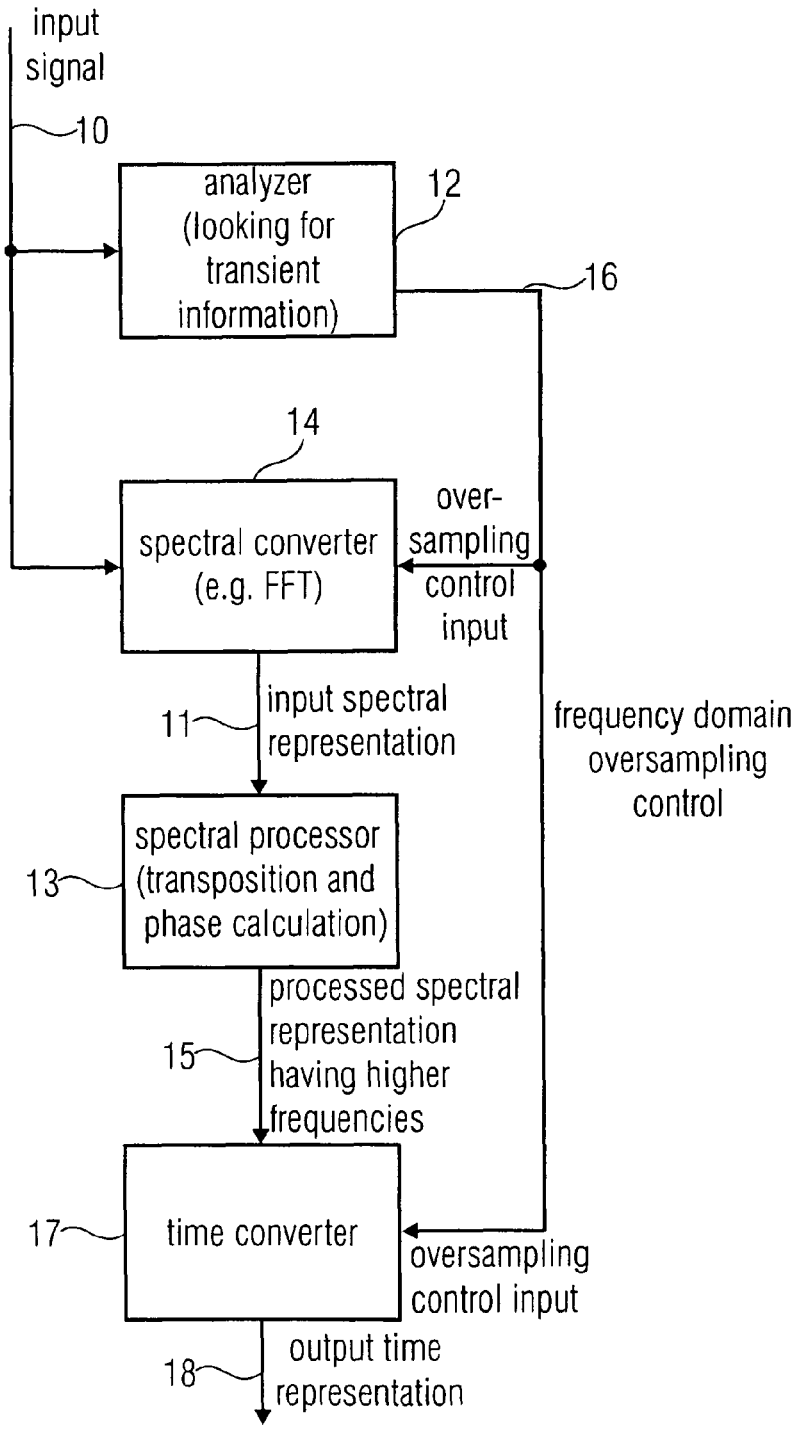
FIG. 1 is a block diagram of an apparatus for generating a high frequency audio signal.

FIG. 1 illustrates an apparatus for generating a high frequency audio signal in accordance with an embodiment. An input signal is provided via an input signal line 10 to an analyzer 12 and a spectral converter 14. The analyzer is configured for analyzing the input signal to determine a transient information to be output on a transient information line 16. Additionally, the analyzer will find out whether there exists a second later portion of the input signal which does not have the transient information. There does not exist signals which are transient. Due to complexity reasons, it is advantageous to perform the transient detection so that the transient portions, i.e., "a first portion" of the input signal occurs quite rarely, since the inventive frequency domain oversampling is reducing the efficiency, but is necessitated for a good quality audio processing. In accordance with the present invention, the frequency domain oversampling is only switched on when it is actually necessitated and is switched off when it is not necessitated, i.e., when the signal is a non-transient signal, although the frequency domain oversampling could even be switched off for transient signals having transient events close to a center of the window as discussed in context of FIG. 7*a*. For efficiency and complexity reasons, however, it is advantageous to mark the certain portion as a transient portion when this portion includes a transient irrespective of whether this transient event is close to a window center or not. Due to the multiple overlapping processing as discussed in the context of FIGS. 4 and 5, each transient will, for some windows, be close to the center, i.e., will be a "good" transient, but will, for another number of windows, be close to the edge of the window and will therefore also be a "bad" transient for these windows.

The spectral converter 14 is configured for converting the input signal into an input spectral representation output on line 11. The spectral processor 13 is connected to the spectral converter via the line 11.

The spectral processor 13 is configured for processing the input spectral representation to generate a processed spectral representation comprising values for higher frequencies than the input spectral representation. Stated differently, the spectral processor 13 performs the transposition, and performs an harmonic transposition, although other transpositions could be performed as well in the spectral processor 13. The processed spectral representation is output from the spectral processor 13 via a line 15 to a time converter 17, where the time converter 17 is configured for converting the processed spectral representation to a time representation. The spectral representation is a frequency domain or filterbank domain representation and the time representation is a straightforward full bandwidth time domain representation, although the time converter can also be configured for directly transforming the processed spectral representation 15 into a filterbank domain having individual subband signals each having a certain higher bandwidth than an FFT filterbank. Therefore, the output time representation on output line 18 can also comprise one or several subband signals, where each subband signal has a higher bandwidth than a frequency line or value in the processed spectral representation.

The spectral converter 14 or the time converter 17 or both elements are controllable with respect to the size of the spectral conversion algorithm to perform a frequency domain oversampling for the first portion of the audio signal having associated the transient information and to not perform the frequency domain oversampling for the second portion of the input signal which does not have the transient information in order to provide a high efficiency and a reduced complexity without any loss of audio quality.

The spectral converter is configured for performing the frequency domain oversampling by applying a longer transform length for the first portion having associated transient information compared to the transform length applied to the second portion, wherein the longer transform length comprises padded data. The difference in length between the two transform lengths is represented by the frequency domain oversampling factor which can be in the range of 1.3 to 3, and is as low as possible but sufficiently large to make sure that "bad transients" as illustrated in FIG. 7 do not introduce any pre-echoes or only introduce small pre-echoes which are tolerable. The value of the oversampling factor is between 1.4 and 1.9.

Subsequently, FIG. 2*a* will be described to provide more details on the spectral converter 14, the spectral processor 13 or the time converter 17 of FIG. 1 in accordance with the embodiment.

Figure 4:
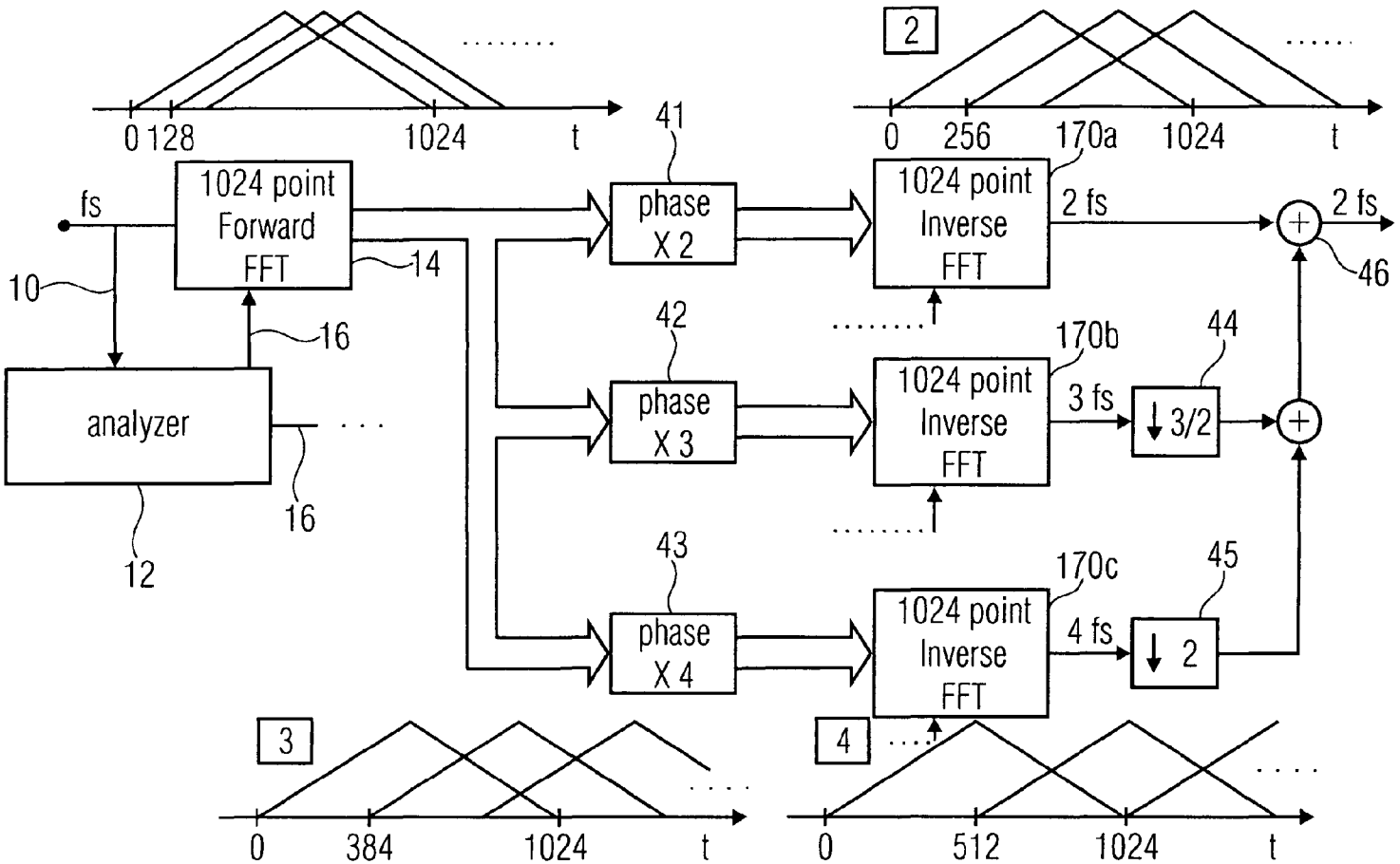
FIG. 4 is an embodiment of the present invention in a framework of several synthesis filterbanks.

The spectral converter 14 comprises an analysis windower 14*a* and an FFT processor 14*b*. Additionally, the time converter comprises an inverse FFT module 17*a*, a synthesis windower 17*b* and an overlap-add processor at 17*c*. An inventive apparatus may comprise a single time converter 17 as, for example, illustrated with respect to FIG. 5 and FIG. 6, or can comprise a single spectral converter 14 and several time converters as illustrated in FIG. 4. The spectral processor 13 comprises a phase processing/transposition module 13*a*, which will be described in more detail subsequently. The phase processing/transposition module can, however, be implemented by any one of the known patching algorithms for generating high frequency lines from low frequency lines within a filterbank such as known from M. Dietz, S. Liljeryd, K. Kjoerling and O. Kunz "Spectral Band Replication, a Novel Approach in Audio Coding", in 112$^{th}$ AES convention, Munich, May 2002. A patching algorithm is additionally described in ISO/IEC 14496-3:2001 (MPEG-4 standard). In contrast to the patching algorithm in the MPEG-4 standard, however, it is advantageous that the spectral processor 13 performs a harmonic transposition in several "rounds" or iterations as discussed in detail with respect to FIG. 6 and the single synthesis filterbank embodiment of FIG. 5.

Figure 2A:
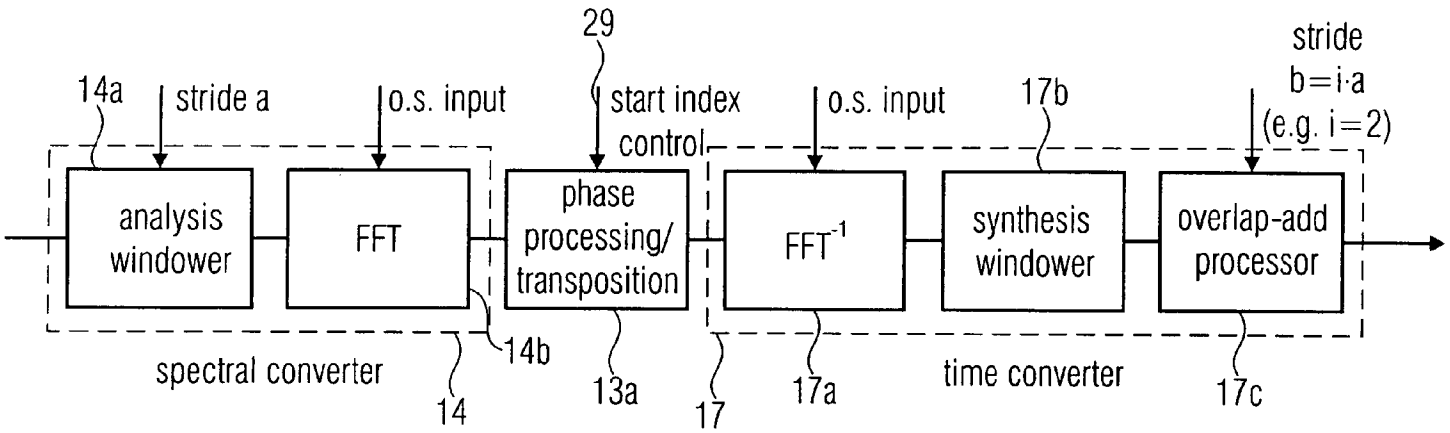
FIG. 2*a* is an embodiment of the apparatus for generating a high frequency audio signal.
Figure 2B:
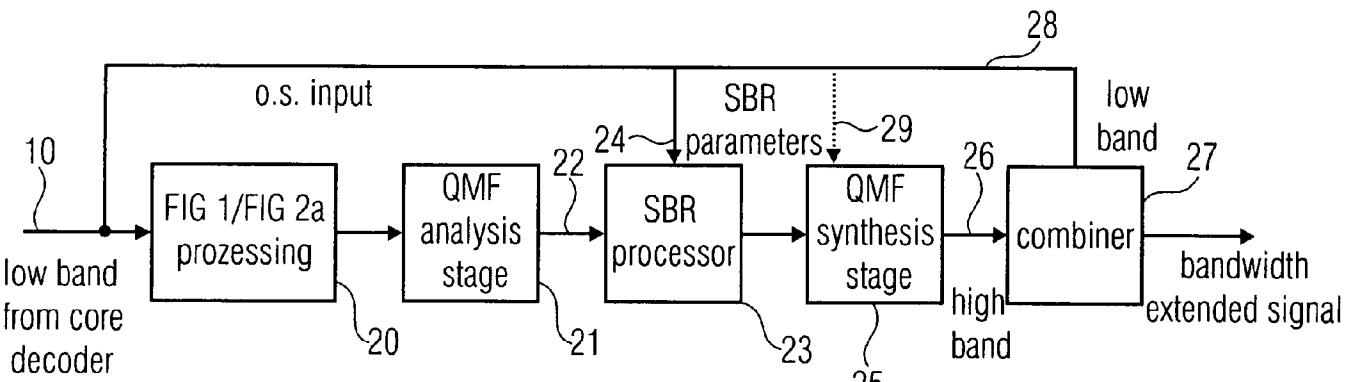
FIG. 2*b* illustrates a spectral band replication processor, which comprises the apparatus for generating a high frequency audio signal of FIG. 1 or FIG. 2*a* as a block of the whole SBR processing to finally obtain a bandwidth extended signal.

FIG. 2*b* illustrates an SBR (spectral band replication) for a high frequency reconstruction processor. On an input line 10 a core decoder output signal which can, for example, be a time domain output signal is provided to block 20, which symbolizes the FIG. 1 or FIG. 2*a* processing. In this embodiment, the time converter 18 finally outputs a true time domain signal. This true time domain signal is subsequently input into a QMF (quadrature mirror filter) analysis stage 21, which provides a plurality of subband signals on line 22. These individual subband signals are input into an SBR processor 23, which additionally receives SBR parameters 24, which are typically derived from an input bitstream, to which the encoded low band signal which is input into the core decoder (not illustrated in FIG. 2*b*) belongs to. The SBR processor 23 outputs an envelope adjusted and in other respects manipulated high frequency audio signal to a QMF synthesis stage 25, which finally outputs a time domain high band audio signal on line 26. The signal on line 26 is forwarded into a combiner 27, which additionally receives the low band signal via bypass line 28. It is advantageous that the bypass line 28 or the combiner introduces a sufficient delay into the low band signal so that the correct high band signal 26 is combined with the correct low band signal 28. Alternatively, the QMF synthesis stage 25 can provide the function of a synthesis stage and a combiner, when the low band signal is also available in the QMF representation and when the QMF representation of the low band is provided into the lower channels of the QMF synthesis stage 25 as illustrated by line 29. In this case, the combiner 27 is not necessitated. Either at the output of the QMF synthesis stage 25 or at the output of the combiner 27, the bandwidth extended audio signal is output. This signal can then be stored, transmitted or replayed via an amplifier and loudspeaker.

FIG. 4 illustrates an embodiment of the present invention relying on the plurality of different time converters 170*a*, 170*b*, 170*c*. Additionally, FIG. 4 illustrates the processing of the analysis windower 14*a* of FIG. 2*a* with an analysis stride a, which is 128 samples in this embodiment. When a length of 1024 samples for an analysis window is considered, then this means an 8-fold overlapping processing of the analysis windower 14*a*.

At the output of block 14, there is the input spectral representation which is then processed via parallely arranged phase processors 41, 42, 43. Phase processor 41, which is part of the spectral processor 13 in FIG. 1 receives, as an input, complex spectral values from the spectral converter 14 and processes each value in such a way that each phase of each value is multiplied by two. At the output of phase processor 14, there exists the processed spectral representation having the same amplitudes as before block 41, but having each phase multiplied by 2. In a similar way, the phase processor 42 determines the phase of each input spectral line and multiplies this phase by a factor of 3. Similarly, phase processor 43 again retrieves the phase of each complex spectral line output by this spectral converter and multiplies the phase of each spectral line by 4. Then, the outputs of the phase processors are forwarded to corresponding time converters 170*a*, 170*b*, 170*c*. Additionally, downsamplers 44 and 45 are provided, where the downsampler 44 has a downsampling factor of 3/2 and the downsampler 45 has a downsampling factor of 2. At the output of the downsamplers 44, 45 and at the output of the time converter 170*a*, all signals are on the same sampling rate which is equal to 2 fs and can, therefore, be added together in a sample by sample manner via adder 46. Hence, the output signal at the adder 46 has two times the sampling frequency of the input signal fs in the left-hand side of FIG. 4. Since the output signal of spectral time converter 170*a* is at double the size of the input sampling rate, an overlap-add processing with a different stride of, in this example, 256 is performed in block 170*a*. Consequently, another overlap-add processing indicated by "3" is formed in time converter b, and an even larger stride of 512 is applied by time converter 170*c*. Although items 44 and 45 perform a Downsampling of 3/2 and 4/2, this downsampling in a sense corresponds to a three times downsampling and a four times downsampling as known from the phase vocoder theory. The factor 1/2 comes from the fact that the output of element 170*a* is anyway on the double sampling frequency compared to the input, and the first processing such as by the combiner 46 is performed on double the sampling rate. In this context, it is to be noted that the increase of the sampling rate to two times the sampling rate or another higher sampling rate may be necessitated, since the spectral content of the high frequency audio signal is higher and, in order to produce a signal without aliasing, the sampling rate also has to increase in accordance with the sampling theorem.

The generation of higher frequencies is performed by feeding the different time converters 170*a*, 170*b*, 170*c*, so that the signals output by the spectral processors 41, 42, 43 are input into the corresponding frequency channels. Additionally, the time converters 170*a*, 170*b*, 170*c* have an increased frequency spacing compared to the input filterbank 14, so that, instead of the same size of these processors, i.e., the same FFT size, the signal generated by this processor represents a higher spectral content, or, stated differently, a higher maximum frequency.

The analyzer 12 is configured for retrieving the transient information from the input signal and to control processors 14, 170*a*, 170*b*, 170*c* to use a larger transform size and to use padded values before the beginning of the windowed frame and after the end of the windowed frame, so that the frequency domain oversampling is performed in an adaptive way. In an alternative embodiment illustrated in FIG. 5, a single synthesis filterbank 17 is employed instead of the three synthesis filterbanks 170*a*, 170*b*, 170*c*. To this end, the phase processor 13 collectively performs a phase processing corresponding to the multiplications by 2, by 3 and by 4 as indicated in blocks 41 to 43 in FIG. 4. Additionally, the spectral converter 14 performs a windowing operation with an analysis stride of 128, and the time converter 17 performs an overlap-add processing with a synthesis stride of 256. The time converter 17 performs a frequency-time conversion while applying a double spacing between individual frequency lines. Since the output of block 17 has, for each window, 1024 values, and since the sampling rate is doubled, the time length of a windowed frame is half the amount of the time length of an input frame. This reduction in length is balanced by applying a synthesis stride of 256 or, stated generally, a synthesis stride of 2 times the analysis stride. Generally, the synthesis stride has to be larger than the analysis stride by a factor, which can be equal to the sampling frequency increase factor.

Figure 5:
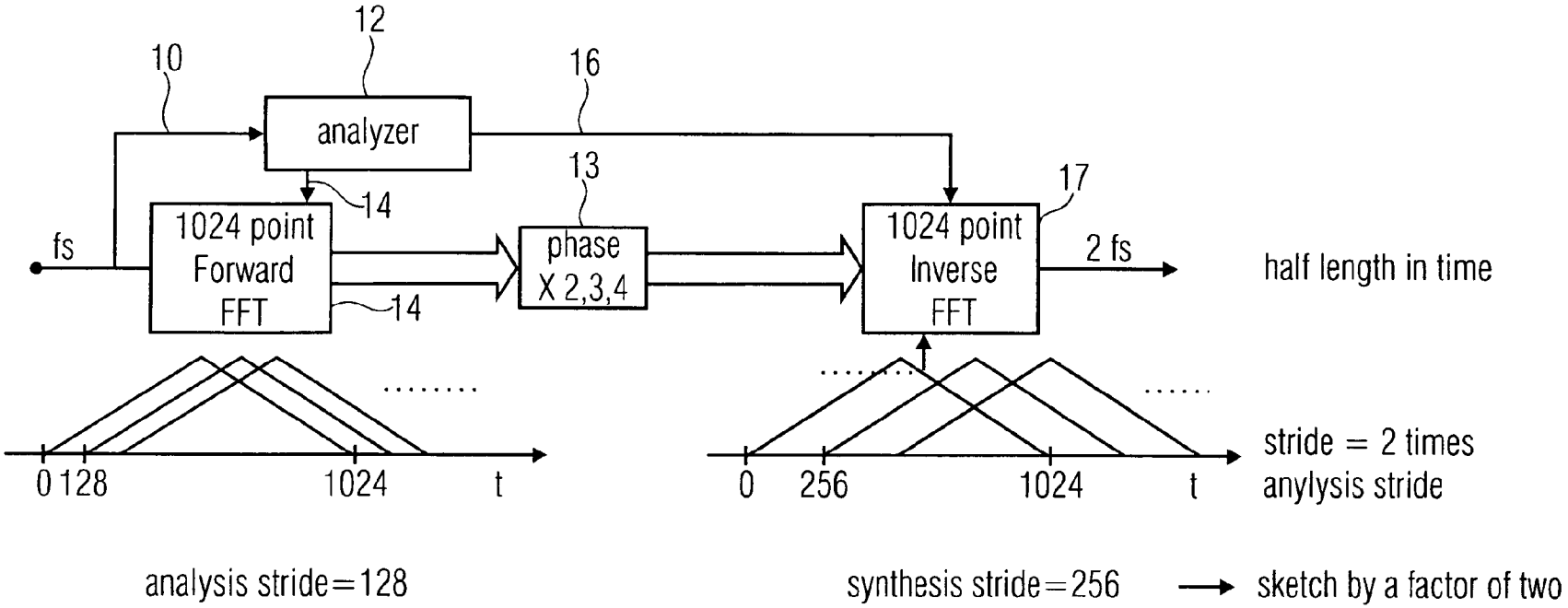
FIG. 5 illustrates another embodiment where a single synthesis filterbank is used.
Figure 6:
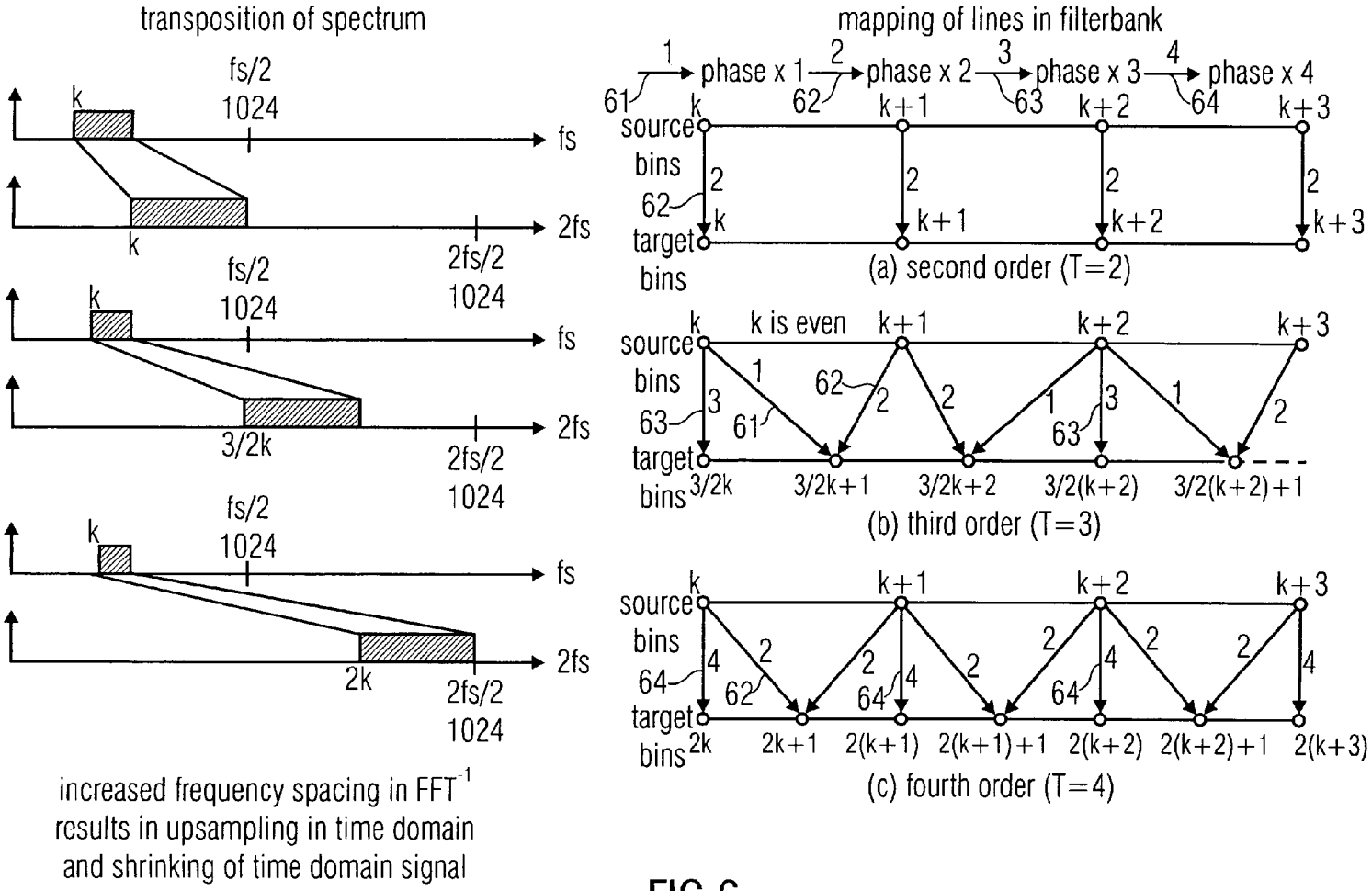
FIG. 6 illustrates the transposition of a spectrum and the corresponding mapping of lines in a filterbank for the FIG. 5 embodiment.

FIG. 5 illustrates an efficient combined filterbank structure for the transposer, where the two lower branches of FIG. 4 are omitted. The third and fourth order harmonics are then produced in the second order bank as illustrated in FIG. 5. Due to the change in filterbank parameters T=3, 4, the simple one-to-one mapping of subbands in FIG. 3 has to be generalized to interpolation rules as discussed in the context of FIG. 6. In principle, if the physical spacing of the synthesis filterbank subbands is two times that of the analysis filterbank, the input to the synthesis band with the index n is obtained from the analysis bands with index k and k+1. Additionally, for definition purposes, it is assumed that k+r represent the integer and fractional representations of nQ/T. A geometrical interpolation for the magnitudes is applied with powers (1−r) and r, and the phases are linearly combined with the weight T(1−r) and Tr. For the example case where Q is equal to 2, the phase mappings for each transposition factor are illustrated graphically in FIG. 6. Specifically, FIG. 6 illustrates, on the left-hand side, a graphical representation of the transposition of the spectrum and, on the right-hand side, the mapping of lines in the filterbank domain, i.e., the feeding of a source line to a target line, where the source line is an output of an analysis filterbank, i.e., a spectral converter, and where the target line or target bin is an input into a synthesis or time converter. This "reconnection" or feeding source bins to target bins actually generates higher frequencies, since, for example, a frequency index k is, as can be seen in the middle and the lower portion of the left-hand side, transposed to a frequency of 3/2 k or 2 k, but in a system having double the sampling rate so that, in the end, the transposition of a physical frequency corresponding to e.g. k in a portion of FIG. 6 indicated by fs to a target frequency k, 3/2 k or 2 k corresponds to a transposition or a physical frequency by 2, 3, or 4, respectively.

Additionally, the first portion on the left-hand side of FIG. 6 illustrates a transposition by a factor of 2, although a frequency line with an index k is mapped to a frequency line with the same index k. The transposition, however, takes place due to the sampling rate conversion by a factor of 2 implicitly performed by using the same FFT kernel size, but with a different frequency spacing, i.e., with a doubled frequency spacing. In view of this, the mapping of lines in the filterbank from the analysis filterbank output (source bins) to the synthesis filterbank inputs (target bins) is straightforward for the first case, since the same indices k are mapped to the same indices k, but the phase of each source bin spectral line is multiplied by two as indicated by the multiply by two arrows 62. This will result in a second order transposition with a transposition factor of two.

In order to actually implement or approximate the third order transposition, the target bins extend from 3/2 k upwards with respect to frequency. The result for the target bins 3/2 k and 3/2 (k+2) is again straightforward, since the corresponding spectral lines in the source bins k, k+2, can be taken as they are, and their phases are respectively multiplied by 3 as illustrated by phase multiply arrows 63. However, the target bin 3/2 (k+1) does not have a direct counterpart in the source bins. When, for example, the small example is considered where k is equal to 4 and k+1 is equal to 5, then 3/2 k corresponds to 6 which, divided by 1.5, results in k=4. However, the next target bin is equal to 7, and 7 divided by 1.5 is equal to 4.66. A source bin having an index 4.66, however, does not exist, since only integer source bins do exist. Therefore, an interpolation between the neighboring or adjacent source bins k and k+1 is performed. Since, however, 4.66 is closer to 5 (k+1) than to 4 (k), the phase information of source bin k+1 is multiplied by two as indicated by arrow 62 and the phase information from source bin k (in the example equal to 4) is multiplied by 1 as shown by a phase arrow 61, which represents a phase multiplication by one. This, of course, corresponds to just taking the phase as it is. These phases, which are obtained by performing the operations symbolized by arrows 61 and 62 are combined, such as added together and the phase multiplication performed by both arrows together results in a multiplication value of 3, which is necessitated for the third order transposition. Analogously, the phase values for 3/ 2k+2 and 3/2 (k+2) +1 are calculated.

A similar calculation is performed for the fourth order transposition, where the interpolated values are, as illustrated by arrows 62 calculated by two adjacent source bins, where the phase of each source bin is multiplied by two. On the other hand, the phases for the directly corresponding target bins which are integer multiples do not need to be interpolated, but are calculated using the phases of the source bins multiplied by four.

It is to be noted that, in an embodiment, where there is a direct calculation of a target bin from a source bin, the phases are only modified with respect to the source bins and the amplitudes of the source bins are maintained as they are. Regarding the interpolated values, it is advantageous to perform an interpolation between the amplitudes of the two adjacent source bins, but other ways of combining these two source bins can also be performed, such as by taking the higher amplitude from the two adjacent source bins or the lower amplitude of the two adjacent source bins or the geometric mean value or an arithmetic mean value or any other combination of the adjacent source bin amplitudes.

Figure 3:
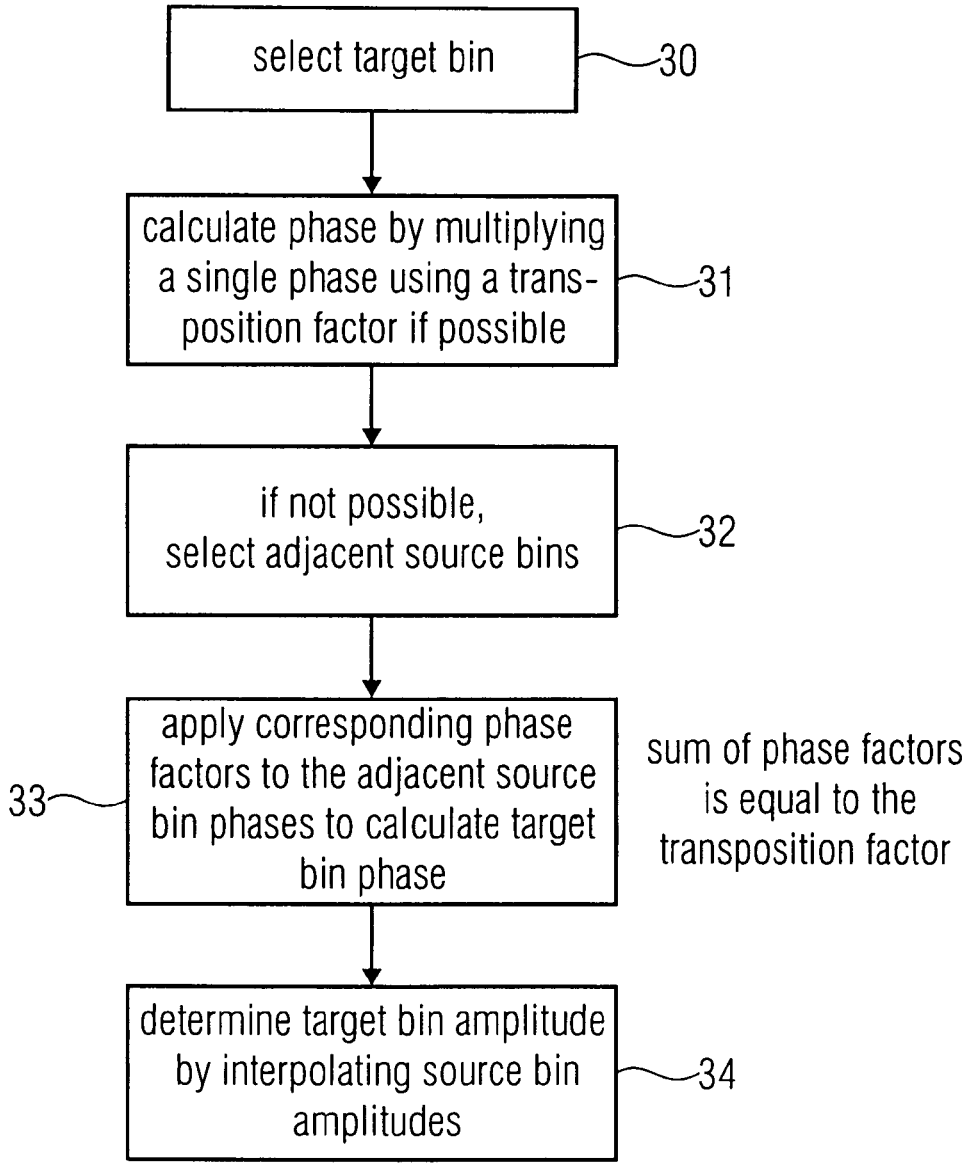
FIG. 3 illustrates an embodiment of processing actions/steps performed within the spectral processor.

FIG. 3 illustrates an embodiment in a flowchart for the procedure in FIG. 6. In step 30, a target bin is selected. Then, in a step 31, a phase is calculated by multiplying a single phase using a transposition factor if possible. Step 31, therefore, applies for the occurrences, where a 3-fold phase multiplication can be performed in the third order transposition or where a multiplication by four (arrows 64) in the fourth order transposition is performed. For calculating the interpolated target bins, it is not possible to directly calculate these values from a single source bin. Instead, adjacent source bins to be used for the interpolation are selected as indicated in step 32. In an embodiment, the adjacent source bins are at two integers which are enclosing a non-integer number obtained by dividing the target bin to be calculated by the integer transposition factor or the fractional transposition factor in the case of a combined upsampling in FIG. 5. Then, in a step 33, the corresponding phase factors are applied to the adjacent source bin phases to calculate the target bin phase. The sum of the phase factors applied to the adjacent source bins is equal to the transposition factor as has been illustrated in the medium portion, for example by applying a one-time phase "multiplication" by arrow 61 and a two-time phase multiplication by arrow 62 to obtain a (1+2) phase multiplication corresponding to the transposition factor T equal to 3 for the third order.

Then, in step 34, the target bin amplitude is determined by interpolating the source bin amplitudes. In an alternative embodiment, the target bin amplitudes can be randomly selected depending on source bin amplitudes or an average target bin amplitude of directly calculated target bins. When a random selection is applied, then an average value or one of the two source bin amplitude values can be prescribed as a medium value for the random process.

The improved transient response of the transposer is obtained by means of frequency domain oversampling, which is implemented by using DFT kernels of length 1024 F and by zero padding the analysis and synthesis windows symmetrically to that length. Here, F is the frequency domain oversampling factor.

For complexity reasons, it is important to keep the amount of oversampling to a minimum, hence the underlying theory will be explained in the following by a sequence of figures.

Consider the prototype transient signal, a Dirac pulse at time $t=t_0$. Hence, multiplying the phase by T seems like the correct thing to do in order to achieve the transform of a pulse at $t=Tt_0$. Indeed, such a theoretical transposer with a window of infinite duration would give the correct stretch of a pulse. For the finite duration windowed analysis, the situation is scrambled by the fact that each analysis block is to be interpreted as a one period interval of a periodic signal with period equal to the size of the DFT.

Figure 7A:
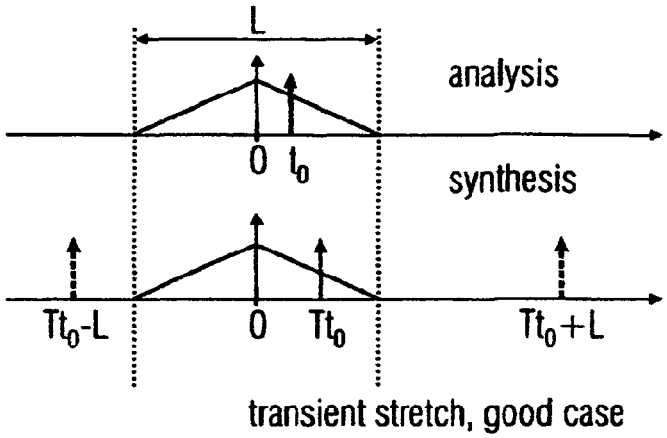
FIG. 7*a* illustrates the transient stretching of a transient event close to the center of a window.

In FIG. 7*a*, the stylized analysis and synthesis windows are depicted on the top and bottom graph respectively. The input pulse at $t=t_0$ is depicted on the top graph with a vertical arrow. Assuming that the DFT transform block is of size L, the effect of phase multiplication by T will produce the DFT analysis of a pulse at $t=Tt_0$ (solid) and cancels the other contributions (dashed). In the next window, the pulse will have another position relative to the center and the desired behavior is to move the pulse to T times its position relative to the center of the window. This behavior guarantees that all contributions add up to a single time stretched synthesized pulse.

Figure 7B:
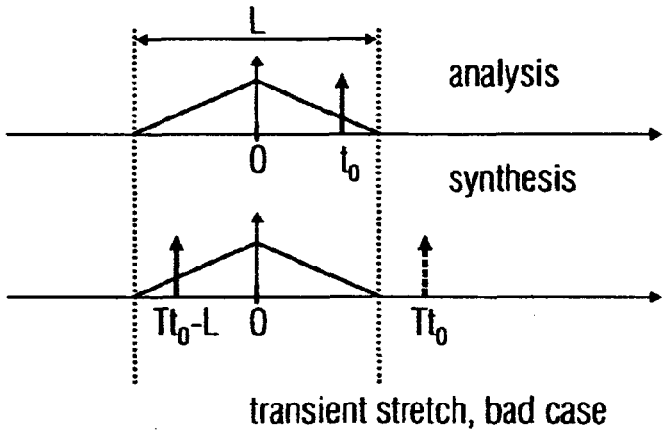
FIG. 7*b* illustrates the stretching of a transient close to the edge of a window.

The problem occurs for the situation of FIG. 7*b*, where the pulse moves further out towards the edge of the DFT block. The component picked up by the synthesis window is a pulse at $t=Tt_0-L$. The final effect on the audio is the occurrence of a re-echo at a time distance comparable to the scale of the (rather long) transposer windows.

Figure 7C:
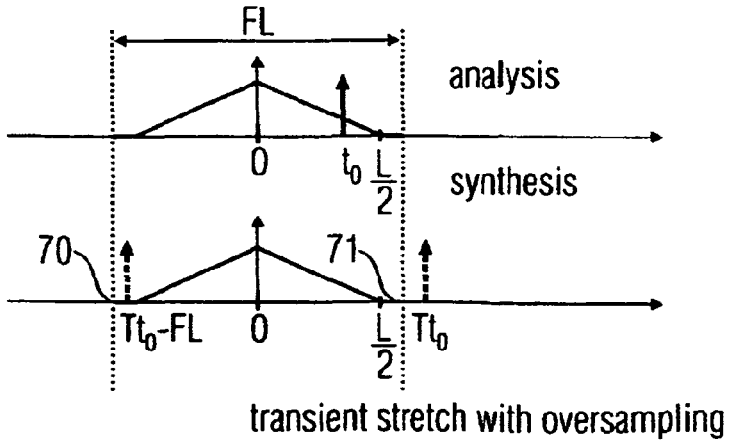
FIG. 7*c* illustrates a transient stretch with oversampling occurring in the first portion of the input signal having associated transient information.

The beneficial effect of frequency domain oversampling is demonstrated by FIG. 7*c*. The size of the DFT transform is increased to FL where L is the window duration and $F\geq 1$.

Now, the period of the pulse trains is FL and the undesired contributions to the pulse stretch can be cancelled by selecting a sufficiently large value of F. For any pulse at position $t=t_0<L/2$ the undesired image at $t=Tt_0-FL$ has to be located to the left of the left edge of the synthesis window at $t=-L/2$. Equivalently, $TL/2-FL\leq L/2$, leading to the rule $$F \geqq \frac{T+1}{2}.$$

A more quantitative analysis reveals that pre-echoes are still reduced by using frequency domain oversampling slightly inferior to the value imposed by the inequality, simply because the windows consist of small values near the edges.

In the transpose as in FIG. 2, the derivation above implies the use of an oversampling factor F=2.5 to cover all the cases T=2, 3, 4. In a previous contribution it was shown that the use of F=2 already leads to a significant quality improvement. In the combined filterbank implementation of FIG. 3 it is sufficient to use the smaller value F=1.5.

Since the oversampling is only necessitated in transient parts of the signal, a transient detection is performed in the encoder and a transient flag is sent to the decoder for each core coder frame to control the amount of oversampling in the decoder. When the oversampling is active, the factor F=1.5 is used at least for all transposer granules for which the analysis window starts in the current core coder frame.

In FIG. 7*c*, the "zero padding" is illustrated as a portion 70 before the first non-zero value of the window and a portion 71 after the last non-zero value of the window. Thus, one could interpret the window in FIG. 7*c* as a new larger window having weighting factors of zero at the beginning and at the end thereof. This would mean that, when this window having a larger length is applied by the analysis window 14*a* or the synthesis window 17*b*, a separate step of "zero-padding" is not necessitated, since the zero-padding is automatically performed by applying a window having a zero portion in the beginning and a zero portion in the end. In an alternative, however, the windows are not changed, but are used in the same shape, but, as soon as a transient detection has been successful, zeros are padded before the beginning of the windowed frame or after the end of the window frame or before the beginning and after the end, and this could be considered as a separate step which is separate from windowing, and which is also separate from calculating the transform. In case of a transient event, therefore, the value padder is activated to pad zeros, so that the result, i.e., the windowed frame and padded zeros is exactly the same as would be obtained when the window having zero portions 70 and 71 illustrated in FIG. 7*c* would be applied.

Similarly, in the synthesis case, one could either apply a specified longer synthesis window in case of a transient event, which would bring to zero the leading values and the last values of a frame generated by the inverse FFT processor 17*a*. However, it is advantageous to apply the same synthesis window, but to simply delete, i.e., cancel values from the beginning of the $FFT^{-1}$ output, where the number of zero values (padded values) is deleted at the beginning and at the end of the block output by processor 17*a* corresponds to the number of the zero-padded values.

Additionally, the detection of a transient event performs a start index control via a start index control line 29 in FIG. 2*a*. To this end, the start indices k, and consequently, also the indices 3/2 k and 2 k are multiplied by the frequency domain oversampling factor. When this factor is, for example, a factor of 2, then each k in the left portion of FIG. 6 is replaced by 2 k. The other procedures, however, are performed in the same way as illustrated.

The transient is signaled for a frame which is used for generating the high frequency enhanced signal, i.e., a so-called SBR frame. Then, the first portion would be an SBR frame containing a transient event and the second portion of the input signal would be an SBR frame later in time not containing a transient. Each window, which has at least a single sample value of this transient frame, therefore would be zero-padded so that when a frame would have the length of one window and when the transient event would be a single sample, this would result in eight windows being transformed using a longer transform with padding values.

The present invention can also be considered as an apparatus for frequency domain transposition, where an adaptive frequency domain oversampling in a filterbank of combined transposers is performed, which is controlled by a transient detector.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Apparatus for generating a high frequency audio signal, comprising:

an analyzer for analyzing an input signal to determine a transient information, wherein a first portion of the input signal has associated the transient information, and a second later portion of the input signal does not comprise the transient information;

a spectral converter for converting the input signal into an input spectral representation;

a spectral processor for processing the input spectral representation to generate a processed spectral representation comprising values for higher frequencies than the input spectral representation; and a time converter for converting the processed spectral representation to a time representation, wherein the spectral converter or the time converter are controllable to perform a frequency domain oversampling for the first portion of the input signal having associated the transient information and to not perform the frequency domain oversampling for the second later portion of the input signal or to perform a frequency domain oversampling with a smaller oversampling factor compared to the first portion of the input signal.

2. Apparatus in accordance with claim 1, in which the spectral converter is configured for performing the frequency domain oversampling by applying a longer transform length for the first portion having associated the transient information compared to the transform applied by the spectral converter for the second later portion, wherein an input to the longer transform length comprises padding data.

3. Apparatus in accordance with claim 1, in which the spectral converter comprises:

a windower for windowing overlapping frames of the input audio signal, a frame comprising a number of window samples, and a time frequency processor for converting the frame into a frequency domain, wherein the time frequency processor is configured for increasing the number of windowed samples by padding additional values before a first windowed sample or subsequent to a last windowed sample of the number of input samples for the first portion of the input signal and to not pad additional values or to pad a smaller number of additional values for the second later portion of the input signal.

4. Apparatus in accordance with claim 2, in which the padded data are zero-padded data.

5. Apparatus in accordance with claim 1, in which the spectral converter comprises a transform kernel comprising a controllable transform length, the transform length being increased for the first portion with respect to the transform length for the second later portion.

6. Apparatus in accordance with claim 1, in which the spectral converter is configured for providing a number of successive frequency lines, wherein the processor is configured for calculating phases for frequency lines higher in frequency by modifying phases or amplitudes of the number of successive frequency lines to acquire the processed spectrum, and wherein the time converter is configured to perform the conversion so that the sampling rate of the time converter output is higher than a sampling rate of the input audio signal.

7. Apparatus in accordance with claim 1, in which the spectral processor is configured for performing a transposition using a transposition factor by processing a spectral portion of the input spectral representation starting at a certain frequency index, and wherein the certain frequency index is higher for the first portion of the input signal and is lower for the second later portion of the input signal.

8. Apparatus in accordance with claim 7, in which a spectral converter or the time converter are configured to perform a frequency domain oversampling for the first input portion using an oversampling factor, and wherein the spectral processor is configured for multiplying the certain frequency index by the oversampling factor for the first portion of the input signal.

9. Apparatus in accordance with claim 1, in which the spectral processor is configured for calculating a value for a higher frequency by combining two frequency adjacent values of the input spectral representation.

10. Apparatus in accordance with claim 9, in which the spectral processor is configured for calculating a phase by interpolating phases of the two frequency adjacent values, or for calculating an amplitude by interpolating amplitudes of the two frequency adjacent values.

11. Apparatus in accordance with claim 1, in which the spectral processor is configured for performing a transposition using a transposition factor, wherein for a target frequency not being an integer multiple of the transposition factor or an integer multiple of the transposition factor divided by an upsampling factor provided by the time converter, the spectral processor is configured for calculating the phase for the target frequency using phases from at least two adjacent spectral values, each multiplied by an individual phase factor, the phase factors being determined so that a sum of the phase factors is equal to the transposition factor.

12. Apparatus in accordance with claim 1, in which the spectral processor is configured for performing a transposition using a transposition factor, wherein for a target frequency not being an integer multiple of the transposition factor or an integer multiple of the transposition factor divided by an upsampling factor provided by the time converter, the spectral processor being configured for calculating the phase for the target frequency using phases from at least two adjacent spectral values each multiplied by an individual phase factor, wherein the phase factor is determined so that the phase factor for a first value of the input spectral value is lower than the phase factor for a second value of the input spectral representation, when an index for the target frequency divided by the transposition factor or divided by a fraction of the transposition factor and the upsampling factor is closer to the second value of the input spectral representation.

13. Apparatus in accordance with claim 1, in which the input signal has associated side information comprising the transient information, and in which the analyzer is configured for analyzing the input signal to extract the transient information from the side information, or wherein the analyzer comprises a transient detector for analyzing and detecting a transient in the input signal based on an audio energy distribution or an audio energy change in the input signal.

14. Method of generating a high frequency audio signal, comprising:

analyzing an input signal to determine a transient information, wherein a first portion of the input signal has associated the transient information, and a second later portion of the input signal does not comprise the transient information;

converting the input signal into an input spectral representation;

processing the input spectral representation to generate a processed spectral representation comprising values for higher frequencies than the input spectral representation; and converting the processed spectral representation to a time representation, wherein in the step of converting into an input spectral representation or in the step of converting to a time representation a controllable frequency domain oversampling is performed for the first portion of the input signal comprising the transient information, wherein the frequency domain oversampling for the second later portion of the input signal is not performed or wherein a frequency domain oversampling with a smaller oversampling factor compared to the first portion of the input signal is performed for the second later portion of the input signal.

15. Non-transitory storage medium having stored thereon a computer program for performing, when running on a computer, the method for generating a high-frequency audio signal, the method comprising:

analyzing an input signal to determine a transient information, wherein a first portion of the input signal has associated the transient information, and a second later portion of the input signal does not comprise the transient information;

converting the input signal into an input spectral representation;

processing the input spectral representation to generate a processed spectral representation comprising values for higher frequencies than the input spectral representation; and converting the processed spectral representation to a time representation, wherein in the step of converting into an input spectral representation or in the step of converting to a time representation a controllable frequency domain oversampling is performed for the first portion of the input signal comprising the transient information, wherein the frequency domain oversampling for the second later portion of the input signal is not performed or wherein a frequency domain oversampling with a smaller oversampling factor compared to the first portion of the input signal is performed for the second later portion of the input signal.

* * * * *